US005087902A

United States Patent [19]

Hyuga et al.

[11] Patent Number: 5,087,902

[45] Date of Patent: Feb. 11, 1992

[54] RESONANT FREQUENCY-TEMPERATURE CHARACTERISTICS COMPENSABLE HIGH FREQUENCY CIRCUIT ELEMENTAL DEVICE

[75] Inventors: Takehiro Hyuga, Ichikawa; Kazutoshi Matsumoto; Tetsuya Mukai, both of Matsudo, all of Japan

[73] Assignee: Sumitomo Metal Mining Co., Ltd., Tokyo, Japan

[21] Appl. No.: 530,284

[22] Filed: May 30, 1990

[51] Int. Cl.[5] ..... H01P 7/10

[52] U.S. Cl. ..... 333/219.1; 333/234; 264/66; 501/135

[58] Field of Search ..... 333/219, 219.1, 229, 333/234, 202; 264/65, 66; 501/134-137

[56] References Cited

U.S. PATENT DOCUMENTS

| | | | |
|---|---|---|---|
| 4,109,359 | 8/1978 | Cross et al. | 310/359 X |
| 4,121,941 | 10/1978 | Kawashima et al. | 333/219.1 X |
| 4,136,320 | 1/1979 | Nishikawa et al. | 333/234 |
| 4,248,727 | 2/1981 | Kawashima et al. | 333/234 X |
| 4,563,661 | 1/1986 | O'Bryan, Jr. et al. | 333/219.1 |
| 4,684,416 | 8/1987 | Masumoto et al. | 148/3 X |
| 4,731,207 | 3/1988 | Matsumoto et al. | 264/25 |
| 4,897,374 | 1/1990 | Matsumoto et al. | 501/134 |
| 5,039,637 | 8/1991 | Hyuga et al. | 264/66 X |

FOREIGN PATENT DOCUMENTS

| | | | |
|---|---|---|---|
| 0211371 | 2/1987 | European Pat. Off. | 333/219.1 |
| 0035454 | 4/1978 | Japan | 333/219.1 |
| 0021101 | 2/1982 | Japan | 333/234 |

*Primary Examiner*—Eugene R. LaRoche
*Assistant Examiner*—Seung Ham
*Attorney, Agent, or Firm*—Foley & Lardner

[57] ABSTRACT

A high frequency circuit elemental device comprising a casing and a dielectric ceramic mounted in said casing, such as oscillators, said dielectric ceramic being capable of undergoing order-disorder structural transformation, whereby the temperature coefficient of the resonant frequency of said elemental device can be compensated by heat-treatment of the dielectric ceramic.

9 Claims, 4 Drawing Sheets

X-ray diffraction pattern (Disordered structure ; Plane indices assigned for cubic system)

X-ray diffraction pattern ( Ordered structure ; Plane indices assigned for hexagonal system )

RESONANT FREQUENCY-TEMPERATURE CHARACTERISTICS COMPENSABLE HIGH FREQUENCY CIRCUIT ELEMENTAL DEVICE

BACKGROUND OF THE INVENTION

1. Field of the Invention

The present invention relates to a resonant frequency-temperature characteristics compensable elemental device, in particular to a device utilizing resonance phenomena of a dielectric ceramic such as resonator systems and oscillator systems of which the resonant frequency temperature coefficient can be compensated by heat-treating the dielectric ceramic used therein.

2. Description of the Prior Art

Cavity resonators, ring resonators, dielectric resonators or the like are used in oscillating systems and filters for communication using high-frequencies such as microwave and milimeter wave. Of these resonators, the dielectric resonators are used extensively by virtue of the advantages that they have good temperature stability of resonant frequencies and are suitable for miniaturization of devices.

High frequency circuit elemental devices comprising a dielectric resonator mounted in a casing include, for example, resonator systems, oscillators for stabilizing high frequencies and filters. It is required for such devices to have good temperature stability of resonant frequencies (or oscillating frequencies) as a whole. For example, local oscillators, one of said oscillators, are assembled by mounting a dielectric resonator, FETs, strip lines, etc. in a casing. In the case of this oscillator, it is required that the influences on the temperature characteristics of the dielectric resonator by the other parts such as FETs and the casing are compensated so that the device may have a temperature coefficient of 0 or so as a whole.

Recently, dielectric ceramics are extensively used as the dielectric resonator. In that case, the temperature coefficient ($\tau f$) of resonant frequency of a dielectric ceramic is fixed based on the composition of the dielectric ceramic. Accordingly, in order to enable the assembled device to have a desired temperature characteristics as a whole, it has been so far necessary to produce a great number of dielectric ceramics having diversity of $\tau f$ in advance, to choose a ceramic with a suitable $\tau f$ for assembly so that the influences by the other parts may be compensated.

The above method of assembly is, however, disadvantageous in that a great number of dielectric ceramics having diversity of $\tau f$ must be produced in advance by changing the composition of individual ceramics. This is extremely troublesome.

The U.S. Pat. No. 4,731,207 discloses a process comprising the step of heating a green compact composed of a calcined product having a composition represented by the formula:

$$xBaO.yMgO.zTa_2O_5$$

wherein x, y and z satisfy $0.5 \leqq x \leqq 0.7$, $0.15 \leqq y \leqq 0.25$, $0.15 \leqq z \leqq 0.25$, and $x+y+z=1$, at a rate of from 100° to 1,600° C./min. up to a temperature of from 1,500° to 1,700° C., and subsequently retaining the green compact at the temperature for not less than 30 minutes. The ceramic produced by this process cannot undergo order-disorder transformation in crystal structure unlike the dielectric ceramic used in the present invention described later. Hence it is impossible to allow the temperature coefficient of the resonant frequencies to be changed by heat-treatment.

SUMMARY OF THE INVENTION

It is, accordingly, an object of the present invention to provide a high frequency circuit elemental device the temperature characteristics of the resonant or oscillating frequency of which can be compensated by merely heat-treating the dielectric ceramic used therein without changing the composition of the ceramic even after assembly of the device.

To achieve the above object, the present invention provides a high frequency circuit elemental device comprising a casing and a dielectric ceramic mounted in said casing, said dielectric ceramic being capable of undergoing order-disorder structural transformation, whereby the temperature coefficient of the resonant frequency can be compensated by heat-treatment.

The temperature characteristics of the resonant frequency of the dielectric ceramic mounted in the device is controllable by heat-treatment. Hence, the temperature characteristics of the resonance frequency of the whole assembled device can be markedly readily compensated.

DETAILED DESCRIPTION OF PREFERRED EMBODIMENTS

Figure 1:
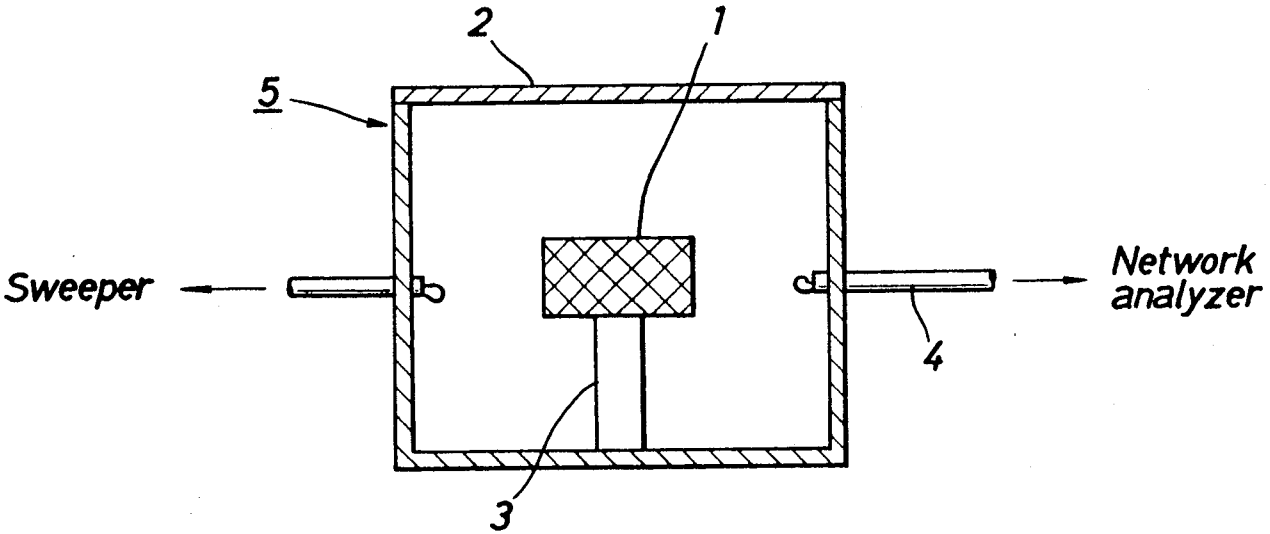
FIG. 1 schematically illustrates the structure of an example of a resonator system.

The high frequency circuit elemental device according to the present invention includes, for example, resonator systems, oscillating systems and filters and the like comprised of a casing and a dielectric ceramic mounted therein.

The terminology "order-disorder structural transformation" herein means (1) reversible transformations in structure which take place by heat-treatment because the substance has so-called a phase transition temperature, and (2) irreversible transformations in structure which take place when an disordered phase formed in non-equilibrium is converted into an ordered phase by heat-treatment.

REVERSIBLE STRUCTURAL TRANSFORMATION

The dielectric ceramics used in two preferred embodiments described below of the present invention, have a perovskite-type complex crystal structure which can undergo reversible order-disorder structural transformation. Heat-treatment at a temperature below its transition temperature results in structural transformation of from a disordered state to an ordered state; while on the other hand, heat-treatment at a temperature above the transition temperature results in the reverse structural transformation. As such transformation takes place, $\tau f$ is changed. As the result, the $\tau f$ of the ceramic can be controlled. In these embodiments, the terminology "disordered crystal structure" means a perovskite type complex crystal structure of which degree of disorder defined by the equation below is 0.4 or less. The terminology "orderd crystal structure" means a structure having a degree of disorder of more than 0.4.

$$\text{Degree of disorder} = \frac{\text{(100) plane diffraction intensity } A / \text{Total of diffraction intensities } A \text{ of (110) plane and (102) plane}}{\text{(100) plane diffraction intensity } B / \text{Total of diffraction intensities } B \text{ of (110) plane and (102) plane}}$$

wherein the (100), (110) and (102) are plane indices of the hexagonal system applied to an X-ray diffraction pattern; and the diffraction intensity A is that of a ceramic to be measured and the diffraction intensity B is that of a ceramic with a completely ordered structure.

In the first preferred embodiment of the present invention, as the dielectric ceramic is used a dielectric ceramic essentially consisting of a compound having an order-disorder structurally transformable perovskite-type complex crystal structure and having the composition represented by the general formula (I):

$$Ba_xA_yB_{1-x-y}F_zO_w \quad \text{(I)}$$

wherein A represents at least one element selected from the group consisting of Mg, Zn, Ni and Co; B is at least one element selected from the group consisting of Ta and Nb; x, y and z are a number of $0.48 \leqq x \leqq 0.52$, $0.15 \leqq y \leqq 0.19$, and $0.00025 \leqq z \leqq 0.05$, respectively; and w is a number that neutralizes the total electric charge of cations of Ba, A and B and anions of F so that the ceramic may be neutral electrically as a whole, and produced by a process comprising the steps of:

calcining a mixture of compounds selected from the group consisting of oxides, fluorides, oxyfluorides and compounds of the metals constituting said compound of the general formula (I) which are converted into oxides, fluorides or oxyfluorides under the heating conditions of this calcining step or the firing step below, at a temperature of from 900° to 1,400° C., molding the calcined product thus obtained, and firing the molded product by heating at a rate of from 100° C. to 1,600° C./min. up to a temperature of not lower than the order-disorder transition temperature of said intended compound of the general formula (I), and maintaining the molded product at the temperature for at least 1 minute.

In the general formula (I), x is a number of from 0.48 to 0.52, preferably from 0.49 to 0.51, y is a number of from 0.15 to 0.19, preferably from 0.16 to 0.18, and z is a number of from 0.00025 to 0.05, preferably from 0.0005 to 0.01. If x, y and/or z is outside the range specified above, desired dielectric properties cannot be attained. The symbol w represents a number such that the cations of Ba, A and B, and the anions of F constituting the ceramic are neutralized electrically. The value of w is automatically fixed based on the values of x, y and z, as well as, if the A contains Co, the valence of Co, and is normally in a range of from 1.49 to 1.51.

In producing the ceramic used in this embodiment, first, as conventionally performed, raw materials of constituent metals are weighed, and mixed in desired amounts according to an intended composition of the general formula (I), and dried, followed by the calcination described above. The raw material compounds which may be used as sources of the constituent metals include, for example, oxides, fluorides and oxyfluorides as well as all sorts of compounds which can be converted into oxides, fluorides or oxyfluorides under the conditions of the calcining or firing step, and specifically include, for example, hydroxides and carbonates. Examples of such compounds include barium carbonate, magnesium oxide, zinc oxide, nickel oxide, cobalt oxide, tantalum oxides such as tantalum pentaoxide, and niobium oxides such as niobium pentoxide, fluorides such as barium fluoride, magnesium fluoride, zinc fluoride, nickel fluoride, cobalt fluoride, and tantalum fluoride, oxyfluorides such as $TaOF_3$, $TaO_2F$ and $NbO_2F$, double fluorides such as $Ba_2MgF_6$, $Ba_2NiF_6$, $BaNiF_4$, $Ba_2CoF_6$, and $BaCoF_4$. Of these compounds, fluorides and oxyfluorides are sources of metal components as well as fluorine. Other fluorine sources which may be used include potassium fluoride, sodium fluoride and lithium fluoride. As conventionally performed, the amounts of the raw materials are preferably set with consideration of easiness or hardness in evaporation of individual components so that a dielectric ceramic with an intended composition may be prepared. The calcination is normally carried out at 900° to 1,400° C., preferably at 1,000° to 1,200° C.

The calcined product obtained may be normally ground and graded if required, and thereafter is molded, and subjected to firing. Firing is carried out by heating the molded product at a rate of from 100° to 1,600° C./min., preferably from 300° to 1,600° C./min, up to a temperature of not less than the order-disorder transition temperature of said intended compound of the general formula (I), specifically from 1,450° to 1,700° C., and maintaining the molded product at the temperature for at least 1 minute, preferably from about 2 minutes to 4 hours. If the heat-treating temperature is below 1,450° C., the sintered density of a ceramic obtained may be not increased sufficiently; if it is above 1,700° C., the structure of the ceramic may be liable to get brittle. In general, heat-treating time after the rapid heating may be shortened with increase in the temperature of heat-treatment.

The fluorine used as a ceramic component in this embodiment promotes sintering to facilitate the formation of a dense ceramic, and also advantageously serves to enhance relative dielectric constant and unloaded Q.

The calcination step and the firing step described above may be carried out in any of oxidizing atmosphere such as oxygen and air, and inert atmosphere such as nitrogen. Normally air can be used satisfactorily.

In the second preferred embodiment of the present invention, as the dielectric ceramic is used a dielectric ceramic essentially consisting of a compound having an order-disorder structurally transformable perovskite-type complex crystal structure and having a composition represented by the general formula (II):

$$Ba_xA_yB_{1-x-y}O_w \quad \text{(II)}$$

wherein A represents at least one element selected from the group consisting of Mg, Zn, Ni and Co; B is at least one element selected from the group consisting of Ta and Nb; x and y are a number of $0.48 \leqq x \leqq 0.52$, and $0.15 \leqq y \leqq 0.19$, respectively; and w is a number that neutralizes the total electric charge of cations Ba, A and B so that the ceramic may be neutral electrically as a whole, and produced by a process comprising the steps of:

calcining a mixture of compounds selected from the group consisting of oxides and compounds of the metals constituting said compound of the general formula (II) which are converted into oxides under the heating conditions of this calcining step or the firing step below, at a temperature of from 900° to 1,400° C., molding the calcined product thus obtained, and firing the molded product by heating at a rate of from 100° C. to 1,600° C./min. up to a temperature of not less than the order-disorder transition temperature of said intended compound of the general formula (II), specifically up to a temperature within the range from 1,450° to 1,700° C., and maintaining the molded product at the temperature for at least 1 minute.

In the general formula (II), if x and/or y is outside the range specified above, desired dielectric properties cannot be obtained. The preferable ranges of x and y are the same as described in respect of the general formula (I). The symbol w normally represents a number of from 1.49 to 1.51.

The compound constituting dielectric ceramic used in the second embodiment needs to essentially have the composition represented by the general formula (II). For example, it should be appreciated that this requirement does not exclude incorporation of fluorine in such an amount that z in the general formula (I) has a number of $z \leqq 0.00025$.

Both of the dielectrics used in the devices of the first and second embodiments have a disordered crystal structure at the stage of completion of the heat-treatment, but the crystal structures can be transformed reversibly at their order-disorder transition temperature. In both ceramics, the order-disorder transition temperature exists generally in a range of from about 1,400° to about 1,500° C. The order-disorder transition temperature of a specific ceramic can be determined readily by experiments using X-ray diffractometry, thermal analysis, etc. Heat-treatment of the above mentioned dielectric ceramics used in the embodiments in the vicinity of and below its order-disorder transition temperature causes structural transformation from the disordered state to an ordered state. Heating the ceramics thus transformed at a temperature above the order-disorder transition temperature causes structural transformation from the ordered state to a disordered state. The time for heat-treatment may be about 10 minutes or longer, normally in the range of from 10 to 50 hours. The degree of order of the crystal structure is attended by change in $\tau_f$. That is, the structural transformation from the disordered state to the ordered state decreases $\tau_f$, and the structural transformation from ordered state to the disordered state increases $\tau_f$. The $\tau_f$ also changes depending on the length of heat-treatment; hence, regulating the length of heat-treating time makes it possible to control $\tau_f$.

IRREVERSIBLE STRUCTURAL TRANSFORMATION

Examples of dielectric ceramics of which $\tau_f$ can be controlled by irreversibly converting a disordered phase formed in non-equilibrium into an ordered phase, include the dielectric ceramic of $Ba(Mg_{\frac{1}{3}}, Ta_{\frac{2}{3}})O_3$ containing a disordered phase in non-equilibrium. Normally, the ordered phase of the ceramic of $Ba(Mg_{\frac{1}{3}}, Ta_{\frac{2}{3}})O_3$ is stable at firing step or the like because this ceramic has no phase transition temperature or because its phase transition temperature is very high. However, in the case where a ceramic with the above composition is prepared by solid phase reaction using $BaCO_3$, MgO and $Ta_2O_5$ as starting materials, said ceramic containing the disordered phase in non-equilibrium can be prepared as a semi-stable phase or a precursor of the ordered phase. The $\tau_f$ of the ceramic of $Ba(Mg_{\frac{1}{3}}, Ta_{\frac{2}{3}})O_3$ containing the disordered phase can be changed by heat-treatment at about 1,300° to 1,700° C.

Other examples of dielectric ceramics of which $\tau_f$ can be controlled by irreversibly converting a disordered phase formed in non-equilibrium into an ordered phase, include the dielectric ceramics of $Ba(Zn_{\frac{1}{3}}, Ta_{\frac{2}{3}})O_3$, $Sr(Mg_{\frac{1}{3}}, Ta_{\frac{2}{3}})O_3$, and $Sr(Zn_{\frac{1}{3}}, Ta_{\frac{2}{3}})O_3$.

The device of the present invention comprises a casing and a dielectric ceramic mounted therein, and optionally further comprises FETs, strip lines, etc. In order for the device to have a desired temperature stability of resonant frequency (or oscillating frequency) as a whole, first, the device is assembled by mounting the dielectric ceramic and all the other parts in the casing, and then the temperature characteristics of resonant frequency of the assembly is measured. If there is a deviation between the designed temperature characteristics and the measured temperature characteristics, said dielectric ceramic is once detached and then is subjected to heat-treatment at a temperature in the vicinity of the order-disorder transition temperature. Thereafter, the ceramic is fitted in the casing again, followed by measurement of the temperature characteristics. By this procedure or by repeating this procedure as necessary, a device with the desired temperature characteristics can be obtained. Therefore, it is not necessary to prepare a great number of dielectric ceramics having diversity of $\tau_f$ in advance for casing and other parts of various sizes and materials. Accordingly, the production process is simple and economically advantageous.

EXAMPLES

The present invention will now be described in more detail with reference to working examples.

EXAMPLE 1

A dielectric ceramic in the shape of a disc having a diameter of 5.77 mm and a length of 2.90 mm composed of a perovskite-type complex compound having the composition of the formula:

$$Ba(Zn_{0.8}Ni_{0.1}Co_{0.1})_{\frac{1}{3}}(Ta_{0.6}Nb_{0.4})_{\frac{2}{3}}$$

which is an order-disorder structurally transformable compound, was produced as follows.

First, barium carbonate, zinc oxide, nickel oxide, cobalt oxide, tantalum oxide and niobium oxide, each with a purity of 99.9%, were weighed so as to give the composition represented by the above formula, and were mixed in pure water with a ball mill for 16 hours. The mixture was dried, and then calcined at 1,000° C. for 2 hours, followed by grinding. The calcined product was molded into a molded product with a diameter of 8 mm and a length of 4 mm, which was then heated at a rate of 600° C./min. up to 1,600° C., and was maintained at 1,600° C. for 5 minutes to produce a dielectric ceramic. This ceramic was then worked so as to give a desired disc with dimentions above.

As shown in FIG. 1, the dielectric ceramic 1 was fixed in the center of a copper-coated cavity 2 made of brass using a quartz tube 3 as a support, thereby a resonator system 5 was produced. The resonator system was swept from its side in the microwave zone by allowing semi-rigid cable 4 to short-circuit at one end as a probe. The resonance point in $TE_{018}$ mode was observed at about 9.2 GHz.

Figure 2:
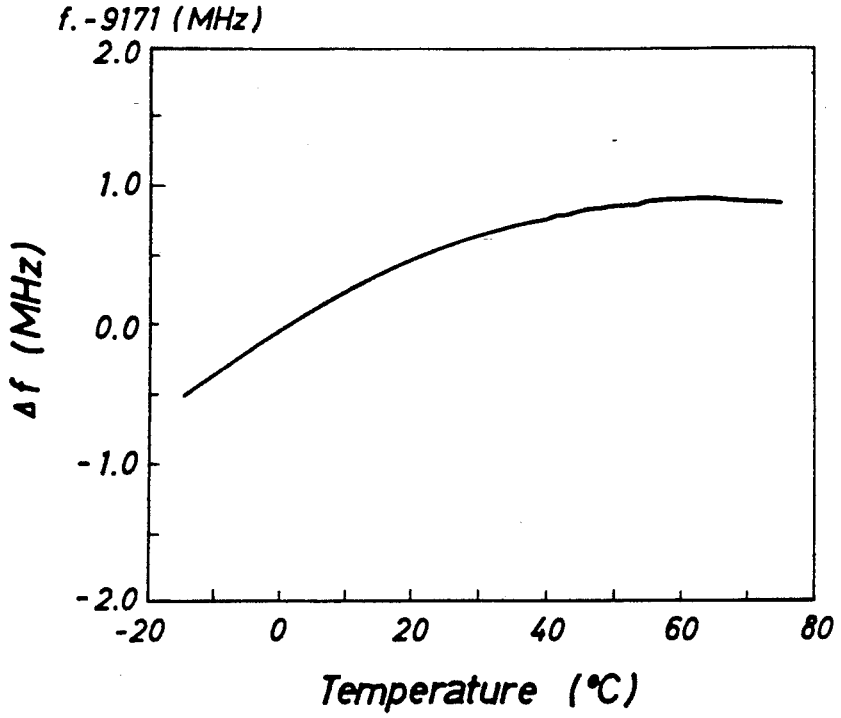
FIG. 2 illustrates the temperature characteristics of the resonant frequency of a dielectric ceramic used in Example 1 before heat-treatment at 1,400° C.
Figure 3:
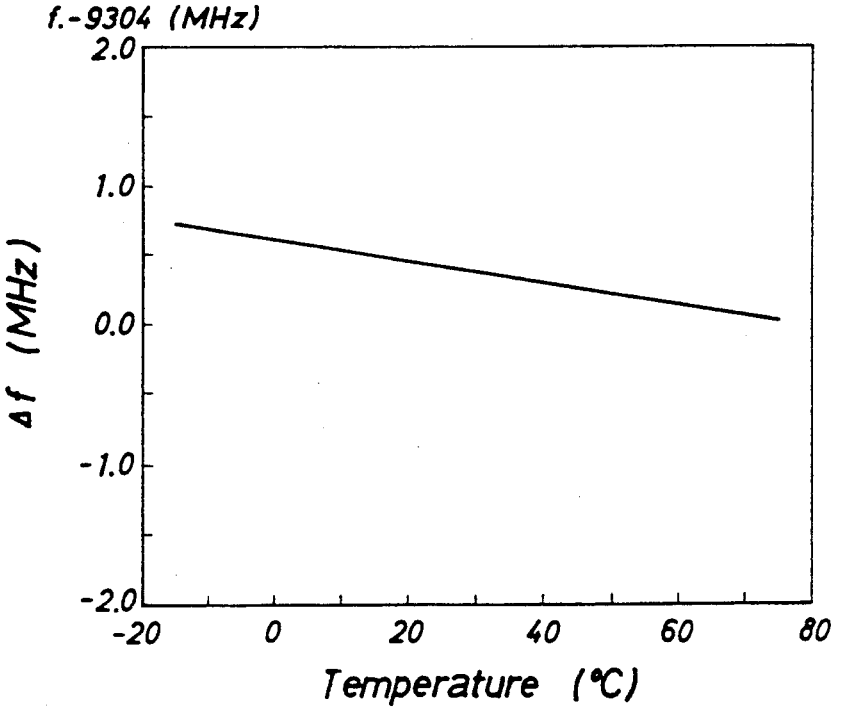
FIG. 3 illustrates that after the same heat-treatment.

Next, the resonator system 5 was placed in a thermostatic chamber. The drift of the resonance in $TE_{018}$ mode by change in temperature was measured over a range from 0° C. to 60° C.; thus the results shown in FIG. 2 were obtained. The temperature coefficient at 20° C. was found to be about 2.2 ppm/° C. In order to improve the temperature characteristics, the dielectric ceramic was heat-treated at 1,400° C. which is below the order-disorder transition temperature for 50 hours. Then, the drift by change in temperature was measured again in the same manner as above, and the results shown in FIG. 3 were thereby obtained. This temperature coefficient became −0.8 ppm/° C. The temperature characteristics exhibit a drift of 500 kHz or less over the range from 0° C. to 60° C., which indicates that the resonator system obtained has markedly high temperature stability.

Figure 4:
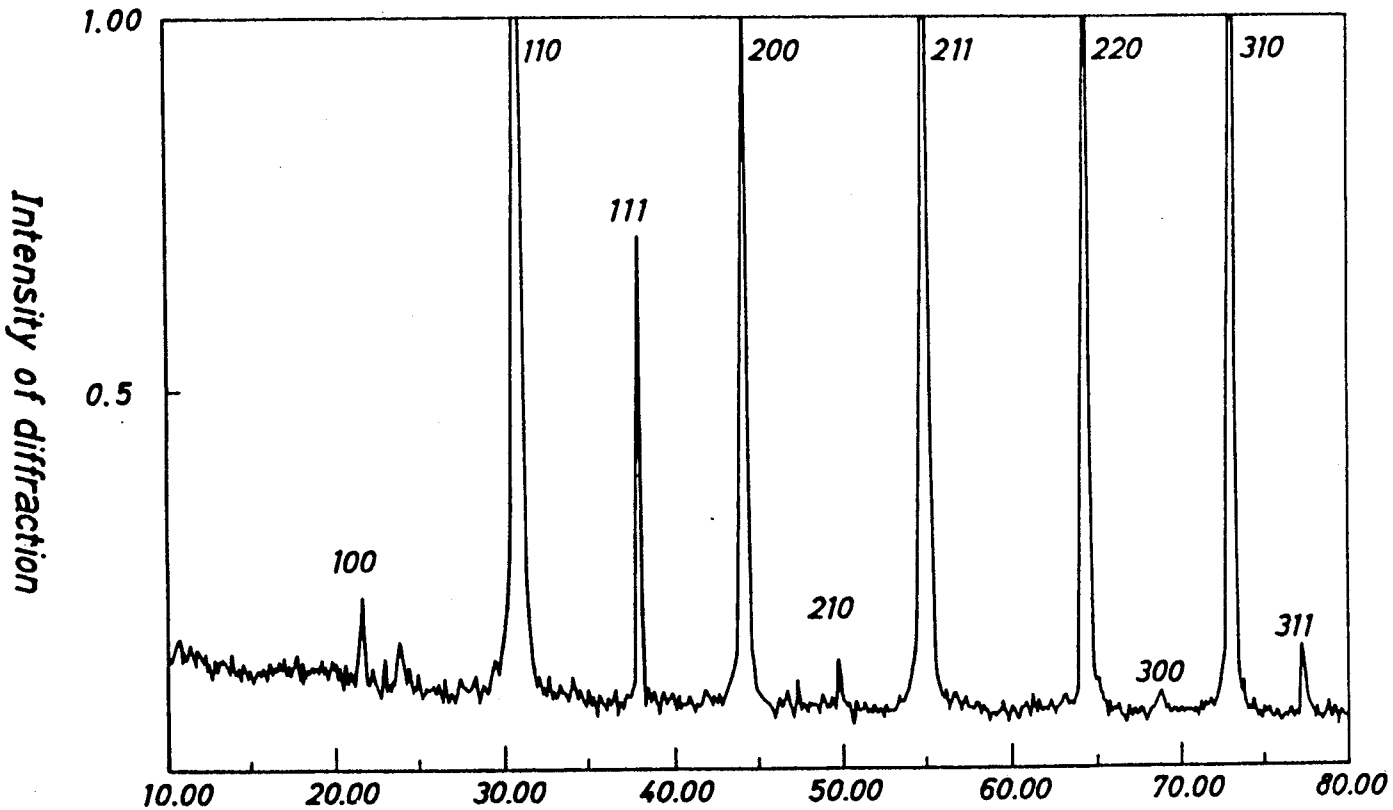
FIG. 4 shows the X-ray diffraction pattern of the above ceramic before the heat-treatment.
Figure 5:
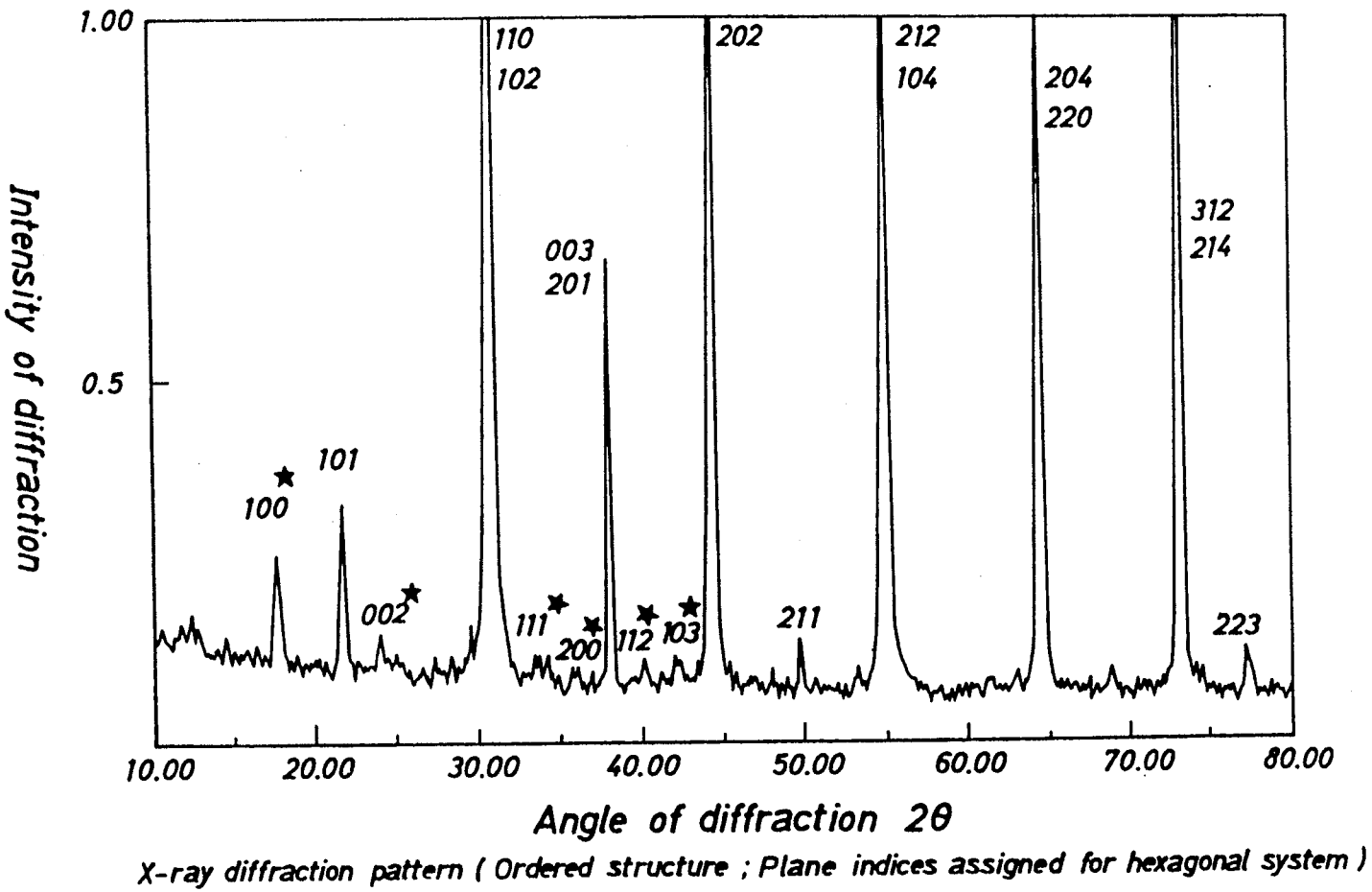
FIG. 5 shows that after the heat-treatment.

The ceramic used in the above resonator system before the above heat-treatment and the same after the above heat-treatment were separately ground, and then subjected to X-ray diffractometry for the purpose of measuring intensities of super lattice lines due to ordered crystal structures. The ceramic before the heat-treatment gave the X-ray diffraction pattern shown in FIG. 4, which is similar to the pattern of the disordered perovskite-type complex crystal structure represented by $Ba(Zn_{\frac{1}{3}}Nb_{\frac{2}{3}})_3$; therefore the ceramic was found to have a disordered crystal structure. On the other hand, the ceramic after the heat-treatment gave the X-ray diffraction pattern shown in FIG. 5, which is similar to the pattern of the ordered perovskite-type complex crystal structure represented by $Ba(Zn_{\frac{1}{3}}Ta_{\frac{2}{3}})_3$; therefore the ceramic was found to have an ordered crystal structure.

EXAMPLE 2

A dielectric ceramic having the composition represented by the formula:

$$Ba(Zn_{0.8}Ni_{0.1}Co_{0.1})_{\frac{1}{3}}(Ta_{0.6}Nb_{0.4})_{\frac{2}{3}}F_{0.04}O_{2.998}$$

was produced in the same manner as in Example 1, except that $BaF_2$ was used as a fluorine source in addition to the starting materials used in Example 1.

A resonator system was assembled in the same manner as in Example 1, except that the dielectric ceramic prepared above was used. The resonance point in $TE_{018}$ mode was measured to be about 9.2 GHz.

The temperature characteristics were measured over the range from 0° to 60° C. in the same manner as in Example 1. Similar results to those in Example 1 were obtained. The temperature coefficient at 20° C. was measured to be 2.5 ppm/° C. After heat-treatment at 1,400° C. for 25 hours, the temperature coefficient was measured to be −0.7 ppm/° C.

We claim:

1. A high frequency circuit elemental device comprising a casing and a dielectric ceramic mounted in said casing, said dielectric ceramic undergoing order-disorder structural transformation when it is heat treated to change the temperature coefficient of the resonant frequency of said elemental device.

2. The elemental device of claim 1, wherein said dielectric ceramic essentially consists of a compound having an order-disorder structurally transformable perovskite-type complex crystal structure and has a composition represented by the general formula (I):

$$Ba_xA_yB_{1-x-y}F_3O_w \quad (I)$$

wherein A represents at least one element selected from the group consisting of Mg, Zn, Ni and Co; B is at least one element selected from the group consisting of Ta and Nb; x, y and z are a number of $0.48 \leqq x \leqq 0.52$, $0.15 \leqq y \leqq 0.19$, and $0.00025 \leqq z \leqq 0.05$, respectively; and w is a number that neutralizes the total electric charge of cations of Ba, A and B and anions of F so that the ceramic may be neutral electrically as a whole, and has been produced by a process comprising the steps of:

calcining a mixture of compounds selected from the group consisting of oxides, fluorides, oxyfluorides and compounds of the metals constituting said compound of the general formula (I) which are converted into oxides, fluorides or oxyfluorides under the heating conditions of this calcining step or the firing step below, at a temperature of from 900° to 1,400° C., molding the calcined product thus obtained, and firing by the molded product heating at a rate of from 100° C. to 1,600° C./min. up to a temperature of not lower than the order-disorder transition temperature of said intended compound of the general formula (I), and maintaining the molded product at the temperature for at least 1 minute.

3. The elemental device of claim 2, wherein in the general formula (I), x is a number of from 0.49 to 0.51, y is a number of from 0.16 to 0.18, and z is a number of from 0.0005 to 0.01.

4. The elemental device of claim 1, wherein said elemental device essentially consists of a compound having an order-disorder structurally transformable perovskite-type complex crystal structure and has a composition represented by the general formula (II):

$$Ba_xA_yB_{1-x-y}O_w \quad (II)$$

wherein A represents at least one element selected from the group consisting of Mg, Zn, Ni and Co; B is at least one element selected from the group consisting of Ta and $0.48 \leqq x \leqq 0.52$, and $0.15 \leqq y \leqq 0.19$, Nb; x and y are a number of respectively; and w is a number that neutralizes the total electric charge of cations of Ba, A and B so that the ceramic may be neutral electrically as a whole, and has been produced by a process comprising the steps of:

calcining a mixture of compounds selected from the group consisting of oxides and compounds of the metals constituting said compound of the general formula (II) which are converted into oxides under the heating conditions of this calcining step or the firing step below, at a temperature of from 900° to 1,400° C., molding the calcined product thus obtained, and firing by the molded product heating at a rate of from 100° C. to 1,600° C./min. up to a temperature of not lower than the order-disorder transition temperature of said intended compound of the general formula (II), and maintaining the molded product at the temperature for at least 1 minute.

5. The elemental device of claim 4, wherein in the general formula (II), x is a number of from 0.49 to 0.51, and y is a number of from 0.16 to 0.18.

6. An elemental device as claimed in claim 1, wherein said dielectric ceramic undergoes a reversible transformation in structure when heat treated.

7. An elemental device as claimed in claim 1, wherein said dielectric ceramic undergoes an irreversible transformation in structure when heat treated.

8. An elemental device as claimed in claim 1, wherein said dielectric ceramic is selected from the group consisting of $Ba(Mg_{\frac{1}{3}}, Ta_{\frac{2}{3}})O_3$, $Ba(Zn_{\frac{1}{3}}, Ta_{\frac{2}{3}})O_3$, $Sr(Mg_{\frac{1}{3}}, Ta_{\frac{2}{3}})O_3$ and $Sr(Zn_{\frac{1}{3}}, Ta_{\frac{2}{3}})O_3$.

9. A method of changing the temperature coefficient of the resonant frequency of a high frequency circuit elemental device, comprising the steps of:

providing a high frequency circuit elemental device comprising a casing and a dielectric ceramic mounted in said casing; and heat treating said dielectric ceramic to change the temperature coefficient of the resonant frequency of said elemental device, said dielectric ceramic undergoing order-disorder structural transformation.

* * * * *